US005192337A

United States Patent [19]

Wajer et al.

[11] Patent Number: 5,192,337

[45] Date of Patent: Mar. 9, 1993

[54] AGENT FOR THE SUPPRESSION OF COAL DUST

[75] Inventors: Mark T. Wajer, Baltimore, Md.; David M. Smith, Kearneysville, W. Va.; Vernon D. Miles, Columbia, Md.

[73] Assignee: Martin Marietta Magnesia Specialties Inc., Bethesda, Md.

[21] Appl. No.: 727,776

[22] Filed: Jul. 10, 1991

[51] Int. Cl.[5] ..... C10L 10/00

[52] U.S. Cl. ..... 44/602; 252/88; 252/43

[58] Field of Search ..... 44/602; 252/88, 43

[56] References Cited

U.S. PATENT DOCUMENTS

| | | | |
|---|---|---|---|
| 1,808,340 | 6/1931 | Botsch | 44/602 |
| 1,912,697 | 6/1933 | Fife | 44/602 |
| 1,979,730 | 11/1934 | Buka | 44/602 |
| 2,005,512 | 6/1935 | Vinz | 44/602 |
| 2,098,232 | 11/1937 | Fife | 44/602 |
| 2,176,127 | 10/1939 | Fife | 44/602 |
| 2,319,942 | 5/1943 | Miller | 44/6 |
| 2,383,543 | 8/1945 | Gray | 44/6 |
| 3,985,517 | 10/1976 | Johnson | 44/1 R |
| 4,201,657 | 5/1980 | Anderson et al. | 44/602 |
| 4,481,122 | 11/1984 | Root et al. | 252/50 |
| 4,498,905 | 2/1985 | Skinner | 44/602 |

OTHER PUBLICATIONS

N. Berkowitz "An Introduction To Coal Technology", Academic Press 1979 pp. 184–195.

D. J. Allardice & D. G. Evans "Analytical Methods For Coal and Coal Products", Academic Press 1978, pp. 247–262.

Dr. Mark Kestner "Using suppressants to control dust emissions—Part I" Powder & Bulk Engineering, Feb. 1989 pp. 17–20.

*Primary Examiner*—Prince Willis, Jr.

*Assistant Examiner*—James Silbermann

*Attorney, Agent, or Firm*—Gay Chin; Alan G. Towner; Bruce M. Winchell

[57] ABSTRACT

Compositions and methods are provided for controlling dust production from coal, for controlling dust losses from coal, for reducing decrepitation, and for facilitating cold-weather handling of coal. The compositions comprise blending oil and petroleum resin where the blending oil can comprise reclaimed motor oil, light or heavy oil obtained from the refining of petroleum crude, virgin or reprocessed vegetable or animal oils, or oils of mineral origin, and where the petroleum resin comprises resin obtained from the deresination of cylinder stocks or cylinder stock itself, or a combination thereof. The petroleum resin may also contain optional ingredients such as diesels and/or bright stock for motor oils to reduce viscosity.

15 Claims, No Drawings

AGENT FOR THE SUPPRESSION OF COAL DUST

FIELD OF INVENTION

The present invention relates to dust control agents for coal. The agents provide benefits such as reducing the dust generated by coals, especially high surface area coals, reducing windage losses during transportation, and retarding decrepitation.

BACKGROUND OF THE INVENTION

Coal is a major fuel source with special significance to the United States which has 25% of the world's coal reserves Coal is formed from plant matter and can be as much as 70 weight percent water. Generally, older coal has less water than more recently formed coal. Coal is classified according to rank which correlates with its age and is based on its stage of coalification. High-rank hard coals such as bituminous and anthracite coals are formed in the final stage of coalification and have moisture content of 10 percent or less. See Karr, *Analytical Methods for Coal and Coal Products,* Academic Press, New York (1978), Vol. I at 247. Low-rank coals, such as brown coals and lignites, are more recently formed and in the intermediate stage of coalification. They typically have high moisture content ranging between 30 and 70 weight percent. Typically, coal from the western United States has as much as 50 weight percent water.

Moisture adds significant weight and can raise transportation costs accordingly. The per ton value of coal is determined by the net heat that can be obtained. The moisture content has the adverse effect of lowering the heating value of the coal because energy is lost in vaporizing the water. For these reasons, coal is dried before transportation to moisture contents typically below 10 percent. Freshly mined coal from the western United States, for example, can have a heating value of 8,400 BTU/pound compared to 10,860 BTU/pound after being thermally dried. However, the efficacy of the drying process is impaired by subsequent difficulties. The drying process causes shrinkage-induced stresses resulting in disintegration. This process is called decrepitation or slacking and can occur to a substantial degree within as few as 48 hours. See Berkowitz, *An Introduction to Coal Technology,* Academic Press, New York (1979) at 189. In addition to decrepitation, the coal is more susceptible to dust production when handled or transported. For some customers, the amount of dust produced by certain types of coal destroys the utility of those coals and therefore reduces the market for those coals. Furthermore, "windage" losses of mature coal from transport in open train cars is about 0.2 weight percent per 100 miles of travel. This windage loss has both economic and environmental costs.

Oil-based sprays have been used for years to coat coal and reduce fragmentation and dust production. The prevalent practice today is to apply #6 fuel oil or a mixture of #6 fuel oil and asphalt at rates greater than three gallons per ton of coal and typically 7 to 10 gallons per ton. These oil-based sprays have several drawbacks. For example, some have low flash points and can cause ignition during transportation or handling. In addition, they add weight to the coal when the primary purpose of drying the coal is to reduce unnecessary weight. Furthermore, their dust suppressant properties deteriorate with time. Typically, prior art oil-based dust suppressants have to be heated to reduce their viscosity in order to enable spray application. High viscosity is required to enable the oil-based suppressants to adhere to the coal, especially if the coal is wet. Dust suppressants also suffer reduced efficacy if they are absorbed below the surface of the coal and therefore incapable of suppressing dust generated from the outer surfaces.

Aqueous agents have been used, but they have not been found to produce satisfactory dust suppression in thermally dried coal and they are absorbed by the coal which reduces the heating value. In addition, aqueous suppressants can freeze in cold weather which makes handling difficult.

U.S. Pat. No. 2,005,512 issued to Vinz on Jun. 18, 1935 discloses a process of treating solid fuels to render them dustless. The process requires use of an asphaltic oil that is too viscous for room temperature application and requires heating to reduce the viscosity for spraying.

U.S. Pat. No. 2,319,942 issued to Miller on May 25, 1943 discloses dust-proofing coal spray compositions and methods that require heating and treatment with oxygen to affect viscosity. The compositions consist of oxygen-treated, non-paraffinic extract of uncracked petroleum lubricating oil stock. The disclosed method involves heating these compositions in order to lower viscosity for spraying solid carbonaceous lump fuel. Miller, therefore, entails added expense due to the special preparation that is required before application and the use of elevated temperatures during application.

U.S. Pat. No. 3,985,517 issued to Johnson on Oct. 12, 1976 discloses a process of crushing coal to particle sizes of less than one-half inch, heating the particulate coal with an inert gas that is heated to a temperature of 250° to 500° F., and simultaneously coating the coal with a heavy liquid hydrocarbon material such as a heavy hydrocarbon residual oil having a boiling range above 650° F. The process requires the coal to be fed through a device which uses the warm gas to both heat and fluidize the coal in order to apply the heavy hydrocarbon dust suppressant.

U.S. Pat. 4,201,657 issued to Anderson on May 6, 1980 discloses a composition of aromatic hydrocarbon oil and asphalt that reduces dust loss and spontaneous combustion. It has a high viscosity to reduce runoff, a high flash point and a high initial boiling point. Anderson requires asphalt which while yielding some beneficial properties necessitates heating prior to application.

U.S. Pat. No. 2,333,543 issued to Gray on Aug. 28, 1945 discloses a coal dust suppressant containing lubricating oil solvent extract and blending oil. No disclosure is made of the use of petroleum resins.

SUMMARY OF THE INVENTION

It is an object of the present invention to provide a dust control agent for suppressing dust generated from the handling or movement of coal, the dust control agent comprising a mixture of blending oil and petroleum resin.

Another object of the present invention is to provide a dust control agent that will reduce decrepitation, and increase the heating value of coal.

Another object of the present invention is to provide a composition that has the environmental benefit of yielding an alternative to dumping or disposal of used oil and of reducing losses of coal dust into the environment.

Another object of the present invention is to provide a method of controlling coal dust comprising coating coal with a mixture comprising blending oil and petroleum resin.

These and other objects of the present invention will be more clearly understood from the description of the preferred embodiments that follows.

DESCRIPTION OF THE PREFERRED EMBODIMENTS

A dust control agent is provided which comprises a mixture of a blending oil and a petroleum resin. The dust control agent may comprise from about 20 to about 99 weight percent blending oil and from about 1 to about 80 weight percent of the petroleum resin. Preferably, the dust control agent comprises from about 50 to about 90 weight percent blending oil and from about 10 to 50 weight percent of petroleum resin. More preferably, the dust control agent comprises from about 60 to 80 weight blending oil and from about 20 to 40 weight percent of petroleum resin. A most preferred dust control agent comprises about 80 weight percent blending oil and about 20 weight percent petroleum resin. The density is from about 7.2 to 8.0 pounds per gallon with a flash point of from about 200° to about 400° F. The dust control agent may have a room temperature viscosity of from about 50 to about 800 cps with a preferred value of about 300 to about 400 cps.

The blending oil can consist of reclaimed motor or engine oils, light or heavy oil obtained from the refining of petroleum crude, virgin or reprocessed vegetable or animal oils, or oils of mineral origin. Reclaimed oil is preferred because of wide availability, low cost, and the environmental benefit of recycling the oil rather than disposing of it. Reclaimed oils also possess a relatively high flash point of well over 200° F. while maintaining sufficiently low viscosity and therefore a higher flowability. The reclaimed oil should have below hazardous levels of unwanted impurities such as arsenic, cadmium, chromium, lead, halogens and PCB's. Other suitable, commercially available blending oils are the A.S.T.M. classified #1, #2, #4, #5(light), and #5(heavy) fuel oils sold by among others, Pennzoil, Ashland, and Quaker State. Number 6 fuel oil is not preferred because its room temperature viscosity is such that elevated temperatures are required for application to the coal.

The petroleum resin component may comprise resin obtained from the deresination of cylinder stocks or cylinder stock itself. These may be blended with, for example, diesels and/or bright stock for motor oils in order to reduce viscosity.

The blending oil/petroleum resin combination of the present invention is believed to produce improved dust suppression due to dissolution by the blending oil of constituents in the resin, such as wax, and deposition of these constituents on the surface of the coal once the blending oil has been absorbed by the coal. The blending oil thus acts as a carrier for the resin while the constituents of the resin give a long-term or residual dust reducing effect, on the order of several weeks, which is not achievable by oil alone.

The preferred rate of application is from about 0.5 to about 5 gallons per ton of coal. A more preferred rate of application is from about 1 to about 3 gallons per ton. A most preferred rate of application is from about 1 to about 2 gallons per ton.

The coal dust agent of the present invention has several positive attributes. There is less loss due to dust and fragmentation. Very little of the agent, e.g. 1 to 3 gallons per ton of coal, is necessary to accomplish its task—as little as one-third of the amount of coal dust control agents currently in use. Therefore, little weight is added to the coal by the application of this product, and less of the composition of the present invention needs to be applied to accomplish the same level of dust suppression achieved by higher amounts of existing dust suppressants. The compositions of the present invention also add heating value of about 120,000 BTU per gallon of agent. In the preferred embodiment, the agent also has the benefit of relatively low viscosity at room temperature which allows for application at ambient temperature without the need to heat the composition. In addition to ambient temperature application, the compositions can be applied at elevated temperatures, such as from about 100° to about 200° F., but such elevated temperatures are not necessary and do not represent the preferred mode.

As an example, one type of coal on which the dust control agent of the present invention can be used has low sulfur content of less than one percent, but moisture content of 30 percent. To make the coal more commercially valuable, it is dried to below 10 percent moisture, where it becomes very friable and dusty, which can result in hazardous conditions such as human inhalation and the potential for dust explosion. The agent of the present invention remedies the dust problem by coating the coal and containing the dust.

The compositions of the present invention also have environmental benefits. Less coal dust is released into the environment during transportation and handling. Also, the compositions of one preferred embodiment of this invention make use of used oil and are a recycling alternative to disposal.

Because dust suppression tends to decline with time, multiple applications of the present compositions may be utilized. For example, a first application to coat all the particles could be performed at the plant site where the coal is conveyed or transferred, or at a blending site. This would reduce dust production at the plant and afterwards. A second application to leave a film on the top of the coal in the train car could be performed at the car load-out site to control dust during transportation to, and unloading at, the customer site. The agents are typically applied by conventional spraying techniques in which the agent is atomized, as opposed to being applied in streams.

Table 1 lists compositions and properties of dust control agents in accordance with the present invention in comparison to #6 fuel oil conventionally used. The blending oil in samples A, B and C comprises reclaimed motor oil, while the resin comprises petroleum resin cut with cylinder stock sold by Pennzoil as VISC 2600. Each of Samples A, B and C are mixed for approximately 15 minutes at a temperature of between 110° and 130° F. in order to achieve complete blending of the ingredients. The samples are then allowed to cool to ambient temperature prior to use.

TABLE 1

| | Composition (wt %) | | Room Temp. | | Flash |
|---|---|---|---|---|---|
| Sample | Blending Oil | Resin | Viscosity (cps) | Density | Point (°F.) |
| A | 90 | 10 | 122 | 7.47 | 205 |
| B | 80 | 20 | 354 | 7.57 | 215 |
| C | 70 | 30 | 680 | 7.57 | 230 |
| #6 Fuel Oil | — | — | 5000 ± 1500 | 8.11 | 150 |

The compositions listed above are evaluated by the following techniques. A predetermined amount of each sample is put in a spray bottle and then sprayed onto a preweighed amount of coal at room temperature. Where #6 fuel oil is used for comparison purposes, it is heated to 175° F. in order to permit application with the spray bottle. The coal in each case has previously been dried to a moisture content of approximately 6 to 10 percent, which produces a very dusty consistency. The amount of spray and the amount of coal used are controlled to give the desired amount of coverage, i.e., the equivalent of 1, 2 or 3 gallons per ton. Typically, 25 pounds of coal are used and the amount of dust control agent is varied accordingly. Once the coal has been sprayed it is placed in a V blender and blended for 30 minutes. The coal is then removed and placed in an open container until the time for testing, e.g., 3 days, 7 days, etc. After the appropriate amount of time, the coal is placed in a dust box to determine its dust content in accordance with ASTM Standard D547-41. The dust box comprises a removable top tray upon which the coal is placed. The tray is quickly removed to allow the coal to drop approximately 4 feet to a collection bin. The chamber through which the coal drops is fitted with a horizontal removable plate located 2 feet above the collection bin. Five seconds after the coal drops through the chamber, this plate is slid into the chamber to seal the collection bin from the rest of the chamber. At the same time, the top tray is also slid back into the chamber to thereby seal the top portion of the chamber. After 2 minutes the top tray is pulled out to allow exposure to the atmosphere. For a total time of 10 minutes after the coal is dropped, the air in the chamber above the middle horizontal plate is sampled and the dust particles 10 microns and smaller are measured by a Ram-1 aerosol monitor manufactured by GCA Corporation. The measurement is printed out on a strip chart recorder and the area below the resultant curve is evaluated to determine the weight of minus 10 micron particles produced. A control sample of coal that has not been treated with a dust control agent is run through the above procedure to establish the weight of minus 10 micron dust produced with no treatment. Percent dust suppression is then calculated by subtracting the weight of dust produced by the treated coal from the weight of dust produced by the non-treated coal and then dividing by the weight of dust produced by the non-treated coal. For example, if the weight of dust produced by the treated coal is measured to be 0.100 grams and the weight of dust produced by the non-treated coal is 1.000 grams, the following calculation is made:

$$\frac{1.000 - 0.100}{1.000} = 0.900$$

A value of 90 percent suppression would thus result.

The results of tests run in accordance with the above procedures are listed in Tables 2 and 3 below. As can be seen, highly improved dust control is achieved by the dust control agents of the present invention. In particular, it is noted that improved dust control can be accomplished with significantly less of the agent of the present invention in comparison to #6 fuel oil conventionally used. Furthermore, the agents of the present invention may be applied by spraying at room temperature rather than heating to elevated temperatures as required by #6 fuel oil.

TABLE 2

Comparison of Sample B with #6 fuel oil

| Treatment | Application | Percent Suppression 3 Days | 7 Days | 14 Days |
|---|---|---|---|---|
| Sample B | 1 gal/ton | 89.8 | 86.1 | 68.2 |
| Sample B | 2 gal/ton | 88.5 | 80.8 | 53.2 |
| #6 Fuel Oil | 3 gal/ton | 54.4 | 38.4 | 38.9 |

TABLE 3

Comparison of varying resin compositions with #6 fuel oil

| Treatment | Application | Percent Suppression 3 Days | 7 Days | 14 Days |
|---|---|---|---|---|
| Sample A | 1 gal/ton | 83.7 | 82.1 | 73.4 |
| Sample B | 1 gal/ton | 90.6 | 78.5 | 59.5 |
| Sample C | 1 gal/ton | 71.7 | — | 40.5 |
| #6 Fuel Oil | 3 gal/ton | 63.0 | 73.1 | 57.8 |

Many modifications and variations of the present invention may be made without departing from its spirit and scope, as will become apparent to those skilled in the art. The specific embodiments described herein are offered by way of example only.

What is claimed is:

1. A dust control agent comprising from about 20 to about 99 weight percent blending oil selected from the group consisting of reclaimed motor oil, oil obtained from petroleum crude, animal oil, vegetable oil, mineral oil, and combinations thereof, and from about 1 to about 80 weight percent petroleum resin obtained from the deresination of cylinder stock.

2. A dust control agent according to claim 1, wherein the petroleum resin further comprises diesels, bright stock for motor oil, or combinations thereof.

3. A dust control agent according to claim 1, wherein the blending oil comprises from about 50 to about 90 weight percent and the petroleum resin comprises from about 10 to about 50 weight percent.

4. A dust control agent according to claim 1, wherein the blending oil comprises from about 60 to about 80 weight percent and the petroleum resin comprises from about 20 to about 40 weight percent.

5. A dust control agent according to claim 1, wherein the blending oil comprises about 80 weight percent and the petroleum resin comprises about 20 weight percent.

6. A dust control agent according to claim 1, wherein the agent reduces coal decrepitation.

7. A dust control agent according to claim 1, wherein the agent has a viscosity of from about 50 to about 800 cps at room temperature.

8. A method of controlling coal dust comprising coating coal with a mixture comprising from about 20 to 99 weight percent blending oil selected from the group consisting of reclaimed motor oil, oil obtained from the refining of petroleum crude, animal oil, vegetable oil, mineral oil, and combinations thereof, and from about 1 to about 80 weight percent petroleum resin obtained from the deresination of cylinder stock.

9. A method according to claim 8, wherein the petroleum resin further comprises diesels, bright stock for motor oil, or combinations thereof.

10. A method according to claim 8, wherein the blending oil comprises from about 50 to about 90 weight percent and the petroleum resin comprises from about 10 to about 50 weight percent.

11. A method according to claim 8, wherein the blending oil comprises from about 60 to 80 weight percent and the petroleum resin comprises from about 20 to about 40 weight percent.

12. A method according to claim 8, wherein the blending oil comprises about 80 weight percent and the petroleum resin comprises about 20 weight percent.

13. A method according to claim 8, wherein said coating is carried out at ambient temperature.

14. A method according to claim 8, wherein said coating is carried out at an elevated temperature of from about 100° to about 200° F.

15. A method according to claim 8, wherein said coating is applied by spraying.

* * * * *